US005505467A

United States Patent [19]

Hill et al.

[11] Patent Number: 5,505,467

[45] Date of Patent: Apr. 9, 1996

[54] ADJUSTABLE SKATE SUPPORT AND BRACKET SYSTEM

[75] Inventors: Martin H. Hill, Syracuse; William H. Dewey, Phoenix, both of N.Y.

[73] Assignee: Built for Speed, Inc., Syracuse, N.Y.

[21] Appl. No.: 293,281

[22] Filed: Aug. 9, 1994

Related U.S. Application Data

[63] Continuation of Ser. No. 74,532, Jun. 11, 1993, abandoned.

[51] Int. Cl.[6] ..... A63C 1/22

[52] U.S. Cl. ..... 280/11.16; 280/11.12

[58] Field of Search ..... 280/11.12, 11.14, 280/11.15, 11.16, 11.17, 11.18, 11.27, 11.3, 7.13

[56] References Cited

U.S. PATENT DOCUMENTS

| | | | |
|---|---|---|---|
| 1,475,224 | 11/1923 | DeOrlow | 280/11.16 |
| 2,230,553 | 2/1941 | Weisman | 280/11.12 |
| 2,414,967 | 1/1947 | Meyers | 280/11.18 |
| 3,243,191 | 3/1966 | Weisman | 280/11.12 |
| 4,114,295 | 9/1978 | Schaefer | 280/11.3 X |
| 4,993,725 | 2/1991 | Barnes et al. | 280/11.14 |
| 5,046,746 | 9/1991 | Gierveld | 280/11.27 X |

FOREIGN PATENT DOCUMENTS

| | | | |
|---|---|---|---|
| 1190571 | 7/1985 | Canada | 280/11.3 |
| 0039090 | 9/1936 | Netherlands | 280/11.12 |
| 7812221 | 6/1979 | Netherlands | 280/11.18 |
| 8800917 | 8/1988 | Netherlands | 280/11.16 |
| 0064256 | 4/1913 | Switzerland | 280/11.15 |
| 0546355 | 4/1977 | U.S.S.R. | 280/11.14 |
| 1725935 | 4/1992 | U.S.S.R. | 280/11.18 |

*Primary Examiner*—Margaret A. Focarino
*Assistant Examiner*—Peter C. English
*Attorney, Agent, or Firm*—Staas & Halsey

[57] ABSTRACT

A skate support and bracket system includes an elongated main body structure in the form of a tubular aluminum extrusion. A bracket attachment track is formed on the extrusion. A pair of boot brackets are slidably mounted on the track for continuous and infinitesimal movement therealong. The brackets carry boot mounting platforms at the upper ends thereof and the platforms are cantilevered outwardly from the upper end of the pedestal both rearwardly and laterally so as to present a generally unimpeded area under the platform to facilitate manipulation of an attachment component.

54 Claims, 4 Drawing Sheets

ADJUSTABLE SKATE SUPPORT AND BRACKET SYSTEM

This application is a continuation, of application Ser. No. 08/074,532, filed Jun. 11, 1993, now abandoned.

BACKGROUND OF THE INVENTION

1. Field of the Invention

The present invention relates to skate support and bracket systems for mounting boots on skates, and in particular to such a system for both ice skates and roller skates which is light weight and strong and provides maximum adjustability for "fine tuning" the skates for high performance levels.

2. The Existing Practices and Structures

Prior art boot mounting systems, such as those illustrated in FIG. 2 of the drawings, are extremely difficult to adjust, particularly under competition conditions, where sometimes split second adjustments are necessary for peak performance. Thus, in order to move the brackets 10, the nut and bolt components 12 must be completely removed, the bracket realigned with a new set of holes 14 and the nut and bolt components reassembled. Moreover, adjustment can be made only in finite increments depending on the spacing between the bolt holes 14.

Additionally, the support platform 16 is cantilevered only in a lateral direction so that the area 18 beneath the platform 16 is impeded and restricted by the proximity of the bracket structure and the bolt heads or nuts holding the bracket in place. Area 18, of course, is used for loosening and tightening nuts on boot studs projecting downwardly through slot 19.

In addition, the bulky, box-like prior art brackets, as illustrated in FIG. 2, are heavy and unwieldy and add weight. Clearly excess weight is detrimental in a performance situation.

SUMMARY OF THE INVENTION

The present invention provides a number of solutions to the problems which exist in connection with previously used skate support and bracket systems. This is accomplished through the provision of a skate support and bracket system comprising an elongated main support body structure having a longitudinal axis and an upper bracket attachment track. The novel skate support and bracket system of the invention also includes at least one boot bracket carried by the body structure. The boot bracket includes a vertically extending pedestal portion having an upper end and a lower end. The lower end is detachably connected to the attachment track of the body structure.

The boot bracket also includes an upper platform attached at the upper end of the pedestal portion. Such platform is adapted for attachment to a skating boot by a conventional stud and nut arrangement. In particular, the platform is cantilevered from the upper end of the pedestal portion in a longitudinal direction relative to the longitudinal axis of the body structure so as to present a generally unimpeded area under the platform to facilitate manipulation of an attachment component such as a nut for the boot stud.

In a preferred form of the invention, the platform is cantilevered from the upper end of the pedestal portion in a longitudinal direction. Even more preferably the platform is cantilevered rearwardly. Additionally, to present a larger unimpeded area under the platform to facilitate manipulation of an attachment component, the platform may also be cantilevered in a lateral direction from the upper end of the pedestal.

In another form of the invention, the skate support and bracket system includes an elongated main support body structure having a centrally located longitudinal axis and an upper longitudinally extending bracket attachment track which is disposed above the axis. The axis and the center of the track are disposed in a common, generally upright plane and the track is configured so as to extend along the support body structure for essentially the entire length thereof. An elongated planar ice skate blade may be carried by the support body structure in such a way that the skate blade is disposed to extend longitudinally of the body structure with the plane of the blade parallel to the plane which is common to the track and axis. The common plane and the blade plane are perpendicularly spaced apart so as to provide an offset for the blade relative to the bracket attachment track. In this form of the invention, at least one boot bracket may be detachably connected to the bracket attachment track for sliding therealong.

In yet another important form, the invention provides a skate support and bracket system which comprises an elongated main support body structure having an upper, centrally located, longitudinally extending bracket attachment track thereon. The track extends along the support body structure for essentially the entire length thereof. In this form of the invention, the system includes at least one boot bracket carried by the body structure. The bracket includes a vertically extending pedestal portion having an upper end and a lower end. The lower end of the pedestal is detachably connected to the bracket attachment track of the body structure. Additionally, the boot bracket includes an upper platform attached at the upper end of the pedestal portion. And once again, in this form of the invention, the platform is adapted for attachment to a skating boot using conventional attachment components.

In some of its more preferred forms, the invention provides an upper bracket attachment track which is elongated and extends longitudinally of the body structure. In addition, the lower end of the pedestal portion may be connected to the track so as to permit sliding of the pedestal portion and therefore the bracket longitudinally of the track. Ideally, the invention may provide a pedestal portion which is continuously and infinitesimally slidable and adjustable along a track which preferably may extend for essentially the entire length of the body structure.

The body structure generally has a front end and a rear end and the pedestal portion may have a front surface which faces the front end of the body structure. Preferably, the front surface of the pedestal portion may be convex.

In another preferred form, the platform may be positioned so that at least a portion thereof is located forwardly of the lower end of the pedestal. Moreover, the upper portion of the front surface may be located forwardly of the lower portion thereof. Furthermore, the front edge of the platform and the upper portion of the front surface of the pedestal may be integrally formed so as to present a continuous swept forward lateral profile.

In a specific preferred form of the invention, the attachment track may comprise a pair of laterally spaced, opposed, parallel, longitudinally extending grooves and the boot bracket may include a pair of laterally spaced, opposed, parallel, longitudinally extending ribs. The ribs may be positioned in the grooves so as to normally slide therealong. The boot bracket may also include a tightening mechanism for forcing the ribs laterally into tight frictional engagement within the grooves to securely maintain the relative position of the boot bracket and the main support body structure.

In another preferred form of the invention, the support body structure may be formed by extrusion and the same may be tubular so as to eliminate excess weight. For the same weight saving purposes, the pedestal portion may be provided with a central cavity which extends therethrough longitudinally of the body structure so as to present a pair of vertically extending, laterally spaced leg segments.

Generally, the system may include two of the boot brackets and such brackets may be spaced apart longitudinally of the track. Desirably, the platform of one of the brackets may be positioned closer to the body structure in a vertical direction than the platform of the other of the brackets. And for adjustably attaching the system of the invention to a skating boot, a laterally extending boot stud receiving slot may be provided in each platform.

DETAILED DESCRIPTION OF THE PREFERRED EMBODIMENTS

Figure 1:
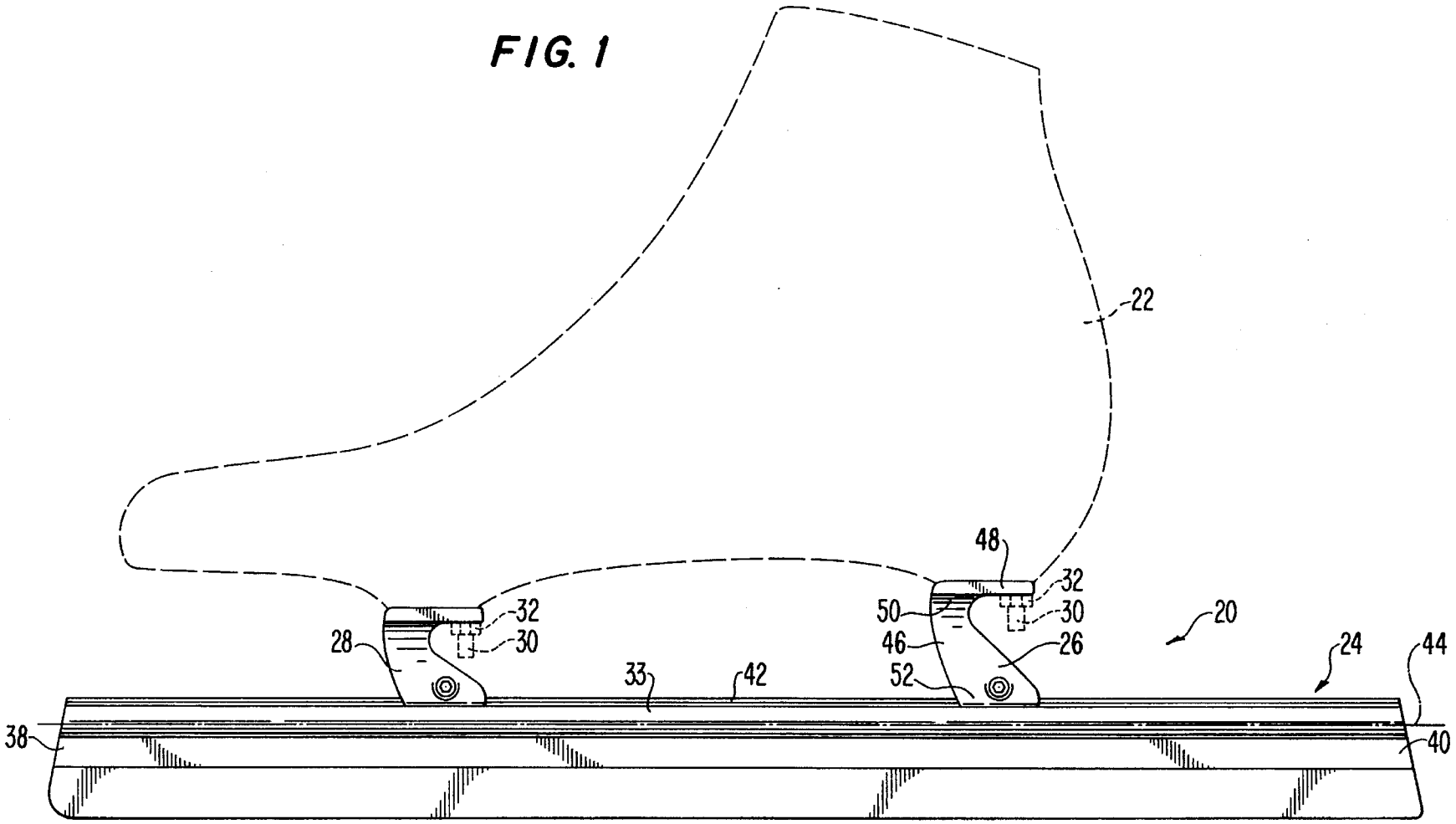
FIG. 1 is a left side elevational view illustrating a skate support and bracket system which embodies the concepts and principles of the present invention, and wherein a skating boot is illustrated by phantom lines.
Figure 2:
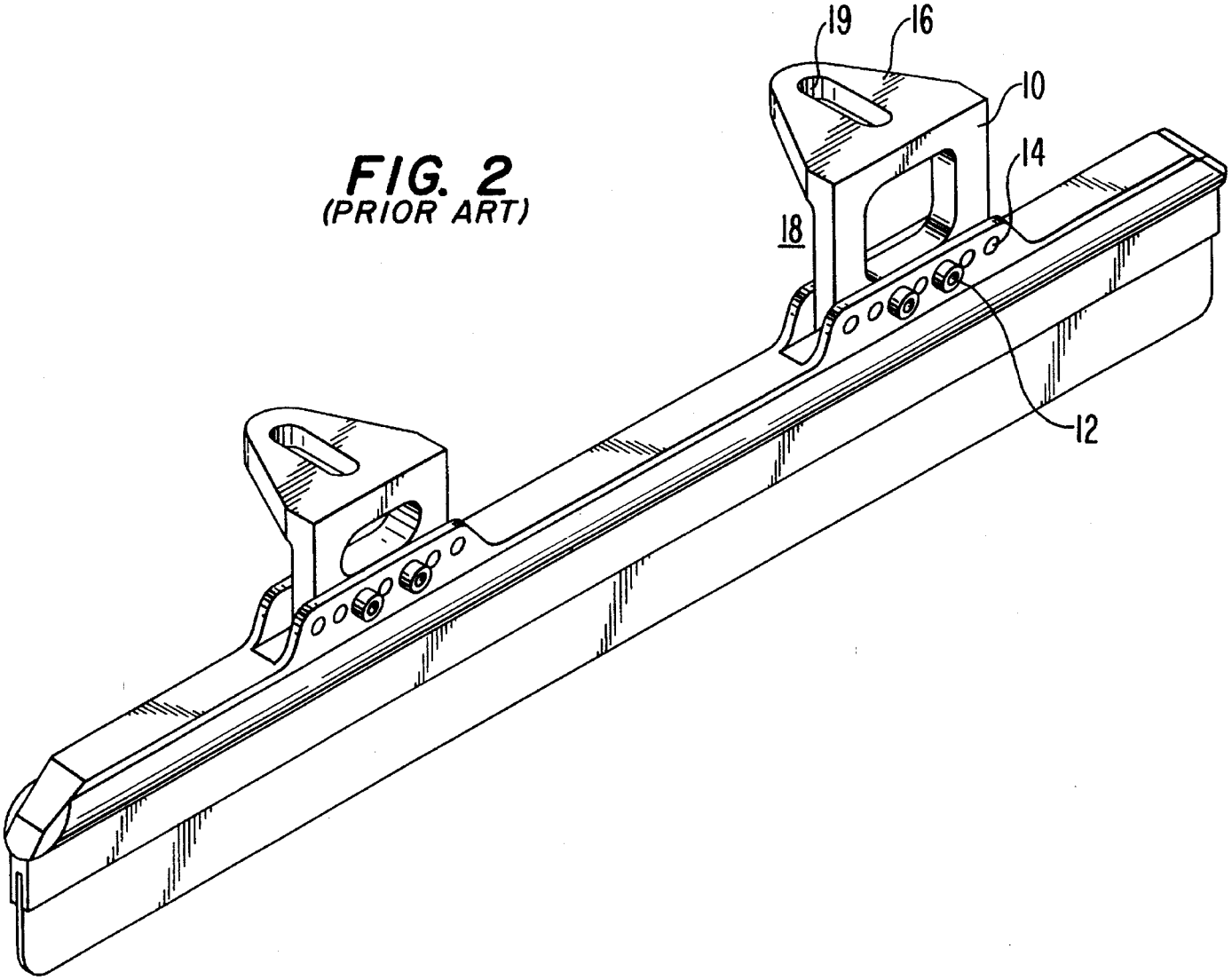
FIG. 2 (PRIOR ART)
FIG. 2 is a perspective view illustrating a prior art skate support and bracket system.

A skate support and bracket system 20 which embodies the concepts and principles of the present invention is illustrated in FIGS. 1 and 3 through 7 of the drawings. With reference to FIG. 1, the skate support and bracket system 20 is illustrated together with a skating boot 22 shown by phantom lines.

The system 20 includes an elongated main support body structure 24. System 20 also includes a rear boot bracket 26 and a front boot bracket 28, which boot brackets are secured to a boot 22 by respective stud 30 and nut 32 assemblies in a conventional manner.

Figures 3, 4, 5, 6, 7:
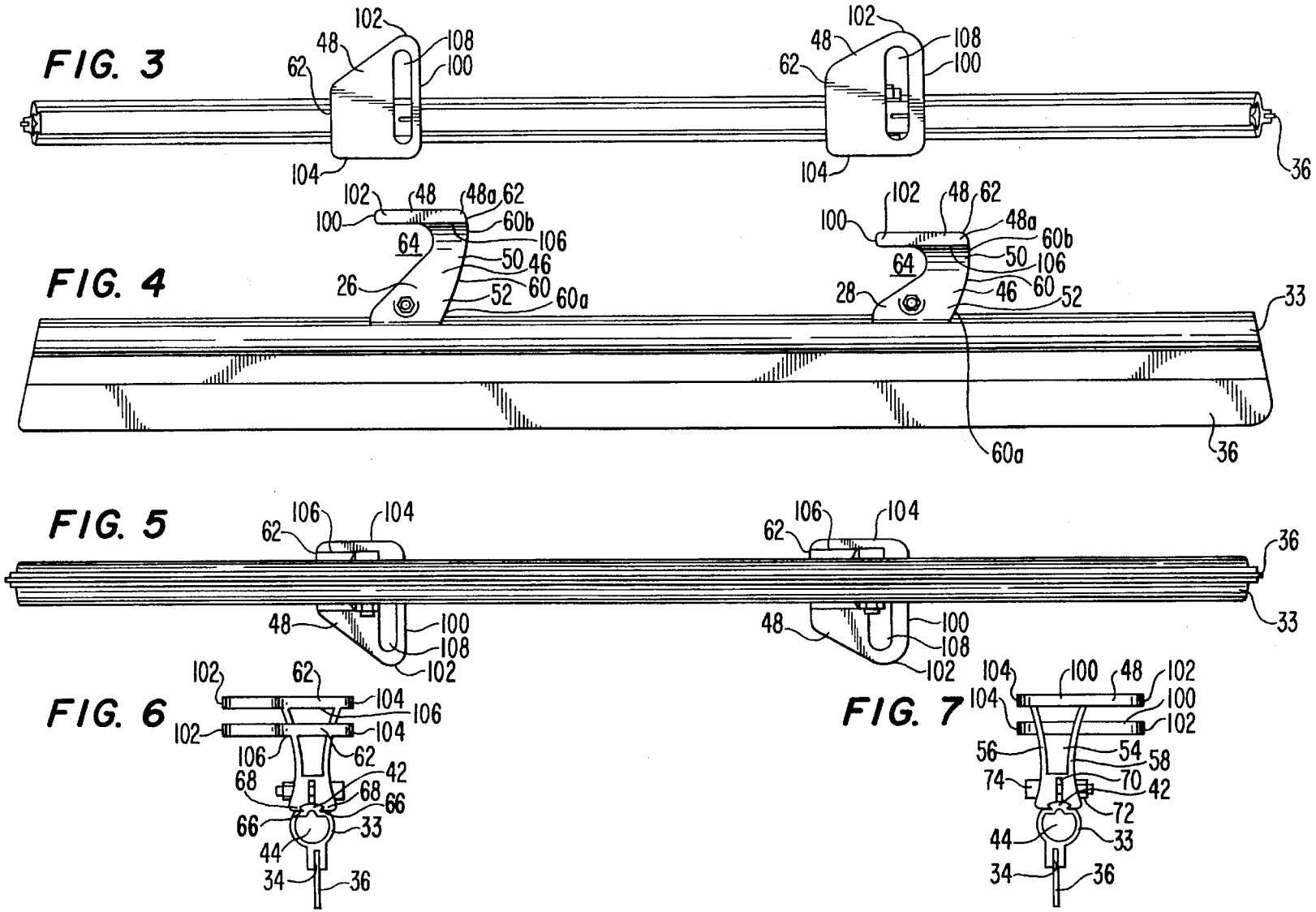
FIG. 3 is a top plan view of the skate support and bracket system of FIG. 1.
FIG. 4 is a right side elevational view of the skate support and bracket system of FIG. 1.
FIG. 5 is a bottom plan view looking upwardly at the skate support and bracket system of FIG. 1.
FIG. 6 is a front end elevational view of the skate support and bracket system of FIG. 1.
FIG. 7 is a rear end view of the skate support and bracket system of FIG. 1.
Figure 8:
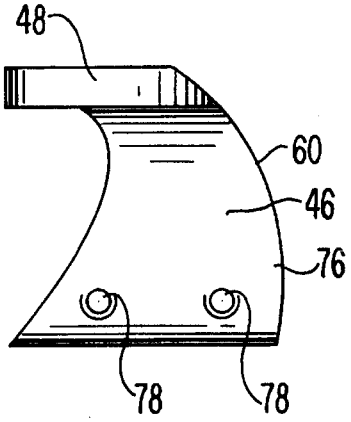
FIGS. 8 through 12 are respectively, right side elevational, front elevational, rear elevational, top plan and bottom plan views of an alternative boot bracket useful in connection with the present invention.
Figure 9:
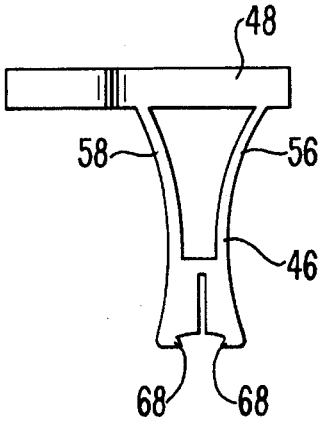
Figure 10:
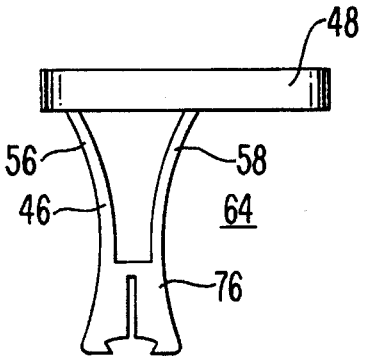
Figure 11:
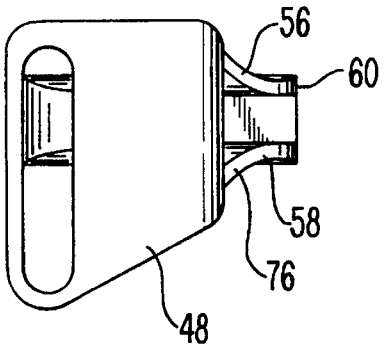
Figure 12:
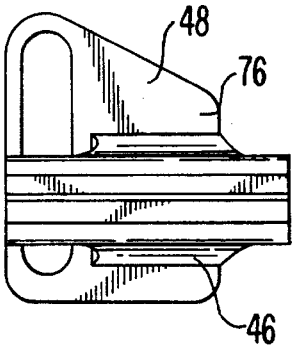

Main support body structure 24 may preferably be formed as a tubular aluminum extrusion 33. Thus, the overall weight of the system may conveniently be reduced. However, as would be readily appreciated by one of ordinary skill in the art, all that is really required is an elongated structural beam type member which may be attached by conventional means to either an ice skate blade or a roller blade skate. With reference to FIGS. 6 and 7, it can be seen that a slot 34 is provided in extrusion 33 to accommodate a conventional stainless steel ice skating blade 36. Blade 36 may desirably be securely held in slot 34 using a conventional epoxy resin material.

As would be appreciated by one of ordinary skill in the art to which the present invention pertains, the basic support and bracket system of the invention may readily be modified for use in connection with a roller blade skate instead of the ice skate blade as illustrated.

Structure 24 (tubular extrusion 33) has a front end 38, a rear end 40 and an upper bracket attachment track 42. Additionally, structure 24 has a centrally located longitudinal axis 44. As can be seen in the drawings, track 42 is elongated and extends longitudinally of axis 44 along the upper side of tube 33 for essentially the entire length of structure 24. And as can be seen viewing FIGS. 6 and 7, track 42 is disposed directly above axis 44. Thus, the center of track 42 and axis 44 are disposed in a common, generally upright plane.

As can be seen in FIG. 4, blade 36 extends longitudinally of structure 24. Moreover, blade 36 is generally planar and the plane thereof is parallel to, but offset slightly laterally relative to the common plane of axis 44 and track 42. Accordingly, these two planes are spaced apart perpendicularly.

Generally speaking, system 20 will include two boot brackets 26, 28 which are spaced apart longitudinally along track 42 and which function in essentially the same way. Rear bracket 26 includes a vertically extending pedestal portion 46 and an upper platform 48.

Platform 48 has a front edge 62, a rear edge 100, an angularly disposed side edge 102 and another side edge 104. Platform 48 also has a support area 106 at a forward portion 48a thereof adjacent front edge 62 and side edge 104, as can be seen viewing FIGS. 3–7. Pedestal portion 46 has an upper end 50 which is attached to support area 106 of platform 48 to thus present a boot attachment shelf which is cantilevered both longitudinally and laterally from said support area 106. Pedestal 46 also has a lower end 52 which is detachably connected to track 42 in a manner to permit sliding of pedestal 46 and therefore of bracket 26 along track 42. With reference to FIG. 7, it can be seen that bracket 26 has a generally trapezodially shaped central cavity therein which extends through pedestal portion 46 in a direction which is longitudinal of body structure 24. Thus, a pair of generally vertically extending, laterally spaced leg segments 56 and 58 are presented. Such cavity 54 saves weight without loss of strength.

Attachment shelf 108 cantilevered outwardly from upper end 50 of pedestal portion 46 in both longitudinal (see FIG. 4) and lateral (see FIG. 7) directions relative to axis 44.

Portion 48*a* of platform 48 is located forwardly of the lower end 52 of pedestal portion 46 so as to provide a swept forward configuration. In this regard, it should be noted that pedestal portion 46 has a generally convex front surface 60 having a lower portion 60*a* and an upper portion 60*b*. The upper portion 60*b* is preferably located forwardly of lower portion 60*a* and the front edge 62 of platform 48 and the upper portion 60*b* of front surface 60 are integrally formed so as to present a continuous swept forward lateral profile (FIG. 4).

A laterally extending slot 108 is preferably provided in platform 48 adjacent rear edge 100 to adapt the latter for laterally adjustable attachment to skating boot 22 via a stud and nut arrangement 30, 32.

With reference to FIG. 4, it should be noted that platform 48 preferably is cantilevered rearwardly relative to pedestal portion 46. Thus, an unimpeded area 64 is provided under platform 48 to facilitate the manipulation of an attachment component such as the nut 32 (FIG. 1).

Preferably, pedestal portion 46 and platform 48 may be formed as a single aluminum casting. Such lightweight metal in combination with the cavity 54 provide a component which is light yet strong.

Track 42 includes a pair of laterally spaced, opposed, generally parallel, longitudinally extending grooves 66. Bracket 26 is provided with a corresponding pair of laterally spaced, opposed, generally parallel, longitudinally extending ribs 68 at the lower end 52 of pedestal portion 46. And as can be seen in FIG. 7, the ribs 68 are positioned within grooves 66 so as to slide therealong while generally maintaining the upright position of bracket 26 relative to track 42. Bracket 26 has a longitudinally extending gap 70 formed therein and a tightening mechanism in the form of a nut 72 and bolt 74 is provided for squeezing the sides of the gap 70 together and thereby force ribs 68 into tight frictional engagement within grooves 66 for holding the bracket 26 in a fixed position relative to track 42 and therefore structure 24.

As mentioned above, system 20 includes a front bracket 28 and a rear bracket 26 which function in essentially the same way. These two brackets also have the same general structural configuration except that the platform 48 of forward bracket 28 may preferably be slightly lower than the platform 48 of rear bracket 26 so as to position the user's foot in an action position. That is to say, the platform 48 of forward bracket 28 is located closer to structure 24 than is the platform 48 of rear bracket 26. A series of brackets may be provided to adjust the relative height of the platforms as necessary to fit the necessities of individual skaters.

As mentioned above, brackets 26 and 28 function in essentially the same way and are also configured similarly. Accordingly, identical reference numerals have been utilized to identify the various components of these two brackets and the commentary set forth above with regard to bracket 26 applies equally with regard to bracket 28.

With reference to FIGS. 8 through 12, an alternative bracket 76 is illustrated. Brackets 76 of various heights may be utilized in the same manner as discussed above in connection with brackets 26 and 28. An important aspect of alternative bracket 76 is that it includes two horizontally spaced bolt holes 78. Thus, the bracket 76 may accommodate a double nut and bolt tightening mechanism for forcing the ribs 68 into even a tighter frictional engagement with the grooves 66 on structure 24. It should be noted in this regard that the bracket 76 is quite similar in other respects to bracket 26 and identical reference numerals have been utilized to designate the various common components of bracket 76.

In particular, the system of the invention contemplates a modular approach for modern skates. The split leg brackets are light weight and yet stronger than prior art varieties. The cantilevered platform allows anything from straight set to extreme left or right offset on any boot. Accordingly, all varieties of ice skate blades or roller skate blades may be attached to bolt on boots, regardless of bolt spacing. By varying the height of the brackets, comfortable boot positioning may be achieved conveniently and quickly.

Both offset and fore-aft blade positions are continuously adjustable, with easy wrench access. Adjusting fore-aft position of the blade may be accomplished quickly since neither nuts nor bolts need to be removed. The procedures involve simply loosening the nuts, adjusting the position and retightening the nuts. Thus, "fine tuning" is quicker and easier than ever before. Higher levels of performance are achieved with less distraction for the skater.

We claim:

1. A skate support and bracket system comprising:

an elongated main support body having a longitudinal axis and an upper bracket attachment track; and at least one boot bracket carried by said body, said boot bracket including a vertically extending pedestal portion having an upper end and a lower end, said lower end being detachably connected to said upper bracket attachment track of the body, said boot bracket further including an upper platform having a front edge, a rear edge, a first side edge, a second side edge and a support area which is positioned closer to said first side edge than it is to said second side edge and which is positioned closer to one of said front and rear edges than it is to the other of said front and rear edges, said support area of the platform being fixed to said pedestal portion at the upper end thereof so that the platform is cantilevered from said upper end of the pedestal portion in both longitudinal and lateral directions relative to said axis to thereby present a cantilevered boot attachment shelf having a generally unimpeded attachment component manipulation area therebeneath, said shelf being provided with attachment structure thereon configured for detachably and adjustably mounting thereon a skate boot having an attachment component extending into said unimpeded area.

2. A skate support and bracket system as set forth in claim 1, wherein said upper bracket attachment track is elongated and extends longitudinally of said axis.

3. A skate support and bracket system as set forth in claim 2, wherein said lower end of the pedestal portion is connected to said upper track of the body so as to permit sliding of the pedestal portion longitudinally of the track.

4. A skate support and bracket system as set forth in claim 3, wherein said pedestal portion is continuously and infinitesimally slidable along said track.

5. A skate support and bracket system as set forth in claim 2, wherein said track extends essentially the entire length of said body.

6. A skate support and bracket system as set forth in claim 5, wherein said lower end of the pedestal portion is connected to said upper track of the body so as to permit sliding of the pedestal portion longitudinally of the track.

7. A skate support and bracket system as set forth in claim 6, wherein said pedestal portion is continuously and infinitesimally slidable along said track.

8. A skate support and bracket system as set forth in claim 2, wherein said system includes two of said boot brackets, said brackets being spaced apart longitudinally of said track.

9. A skate support and bracket system as set forth in claim 8, wherein the platform of one of said brackets is closer to the body in a vertical direction than the platform of the other of said brackets.

10. A skate support and bracket system as set forth in claim 1, wherein said support area is positioned closer to said front edge than it is to said rear edge so that the boot attachment shelf is cantilevered rearwardly from said upper end of the pedestal portion.

11. A skate support and bracket system as set forth in claim 10, wherein said body has a front end and a rear end and said pedestal portion has a front surface adjacent the front edge of said platform which faces the front end of the body, said front surface being convex.

12. A skate support and bracket system as set forth in claim 10, wherein said body has a front end and a rear end and said platform is positioned so that at least said front edge thereof is located forwardly of the lower end of the pedestal.

13. A skate support and bracket system as set forth in claim 12, wherein said pedestal portion has a front surface with a lower portion and an upper portion, said upper portion of the front surface being located forwardly of the lower portion thereof, said front edge and said upper portion being integrally formed so as to present a continuous swept forward lateral profile.

14. A skate support and bracket system as set forth in claim 13, wherein said front surface is convex.

15. A skate support and bracket system as set forth in claim 1, wherein said attachment track comprises a pair of laterally spaced, opposed, parallel, longitudinally extending grooves and said boot bracket includes a pair of laterally spaced, opposed, parallel, longitudinally extending ribs, said ribs being positioned in said grooves for sliding therealong.

16. A skate support and bracket system as set forth in claim 15, wherein said boot bracket includes a tightening mechanism for forcing the ribs laterally into tight frictional engagement with said grooves.

17. A skate support and bracket system as set forth in claim 1, wherein said body is an extruded body.

18. A skate support and bracket system as set forth in claim 17, wherein said body is tubular.

19. A skate support and bracket system as set forth in claim 1, wherein said pedestal portion has a central cavity extending therethrough longitudinally of said body presenting a pair of vertically extending laterally spaced leg segments.

20. A skate support and bracket system as set forth in claim 19, wherein said central cavity is substantially trapezoidal in shape.

21. A skate support and bracket system as set forth in claim 1, wherein a laterally extending boot stud receiving slot is provided in said boot attachment shelf.

22. A skate support and bracket system as set forth in claim 1, wherein is included an ice skate blade carried by said body.

23. A skate support and bracket system comprising:

an elongated main support body having a centrally located longitudinal axis and an upper longitudinally extending bracket attachment track disposed above said axis, said axis and said track being disposed in a common, generally upright plane, said track extending along said support body for essentially the entire length thereof;

an elongated generally planar ice skate blade carried by said body, said blade being disposed so as to extend longitudinally of said body with the plane of the blade parallel to said common plane, said common plane and said blade plane being laterally spaced apart; and at least one boot bracket detachably connected to said bracket attachment track for sliding therealong.

24. A skate support and bracket system as set forth in claim 23, wherein said boot bracket includes a vertically extending pedestal portion having an upper end and a lower end, said lower end being detachably connected to the bracket attachment track, said boot bracket further including an upper platform attached at the upper end of the pedestal portion, said platform being adapted for attachment to a skating boot, said platform being cantilevered from said upper end of the pedestal portion in both longitudinal and lateral directions relative to said axis so as to present a generally unimpeded area under the platform to facilitate manipulation of an attachment component.

25. A skate support and bracket system as set forth in claim 24, wherein said lower end of the pedestal portion is connected to said upper track of the body so as to permit sliding of the pedestal portion longitudinally of the track.

26. A skate support and bracket system as set forth in claim 25, wherein said pedestal portion is continuously and infinitesimally slidable along said track.

27. A skate support and bracket system as set forth in claim 24, wherein said body has a front end and a rear end and said platform is cantilevered rearwardly from said upper end, said pedestal portion having a front surface which faces the front end of the body, and said front surface being convex.

28. A skate support and bracket system as set forth in claim 24, wherein said body has a front end and a rear end and said platform is cantilevered rearwardly from said upper end, said platform being positioned so that at least a portion thereof is located forwardly of the lower end of the pedestal portion.

29. A skate support and bracket system as set forth in claim 28, wherein said platform has a front edge and said pedestal portion has a front surface with a lower portion and an upper portion, said upper portion of the front surface being located forwardly of the lower portion thereof, said front edge and said upper portion being integrally formed so as to present a continuous swept forward lateral profile.

30. A skate support and bracket system as set forth in claim 24, wherein said pedestal portion has a central cavity extending therethrough longitudinally of said body presenting a pair of vertically extending laterally spaced leg segments.

31. A skate support and bracket system as set forth in claim 30, wherein said central cavity is substantially trapezoidal in shape.

32. A skate support and bracket system as set forth in claim 24, wherein a laterally extending boot stud receiving slot is provided in said platform.

33. A skate support and bracket system as set forth in claim 23, wherein said attachment track comprises a pair of laterally spaced, opposed, parallel, longitudinally extending grooves and said boot bracket includes a pair of laterally spaced, opposed, parallel, longitudinally extending ribs, said ribs being positioned in said grooves for sliding therealong.

34. A skate support and bracket system as set forth in claim 33, wherein said boot bracket includes a tightening mechanism for forcing the ribs laterally into tight frictional engagement with said grooves.

35. A skate support and bracket system as set forth in claim 23, wherein said body is an extruded body.

36. A skate support and bracket system as set forth in claim 35, wherein said body is tubular.

37. A skate support and bracket system as set forth in claim 23, wherein said system includes two of said boot brackets, said brackets being spaced apart longitudinally of said track.

38. A skate support and bracket system as set forth in claim 37, wherein the platform of one of said brackets is closer to the body in a vertical direction than the platform of the other of said brackets.

39. A skate support and bracket system comprising:

an elongated main support body having a longitudinal axis and an upper bracket attachment track; and at least one boot bracket carried by said body, said boot bracket including a vertically extending pedestal portion having an upper end and a lower end, said lower end being detachably connected to said upper bracket attachment track of the body, said boot bracket further including an upper platform having a front edge, a rear edge, and a support area which is positioned closer to one of said front and rear edges than it is to the other of said front and rear edges, the upper end of said pedestal portion being fixed to said platform solely at said support area thereof so that said platform is cantilevered from said upper end of the pedestal portion in a longitudinal direction relative to said axis to thereby present a cantilevered boot attachment shelf having a generally unimpeded attachment component manipulation area therebeneath, said shelf being provided with attachment structure thereon configured for detachably and adjustably mounting thereon a skating boot having an attachment component extending into said unimpeded area.

40. A skate support and bracket system as set forth in claim 39, wherein said body has a front end and a rear end and said support area is positioned closer to said front edge than it is to said rear edge so that the shelf is cantilevered rearwardly from said upper end of the pedestal portion.

41. A skate support and bracket system as set forth in claim 40, wherein said pedestal portion has a front surface which faces the front end of the body, said front surface being convex.

42. A skate support and bracket system as set forth in claim 40, wherein said platform is positioned so that at least a portion thereof is located forwardly of the lower end of the pedestal.

43. A skate support and bracket system as set forth in claim 42, wherein said pedestal portion has a front surface with a lower portion and an upper portion, said upper portion of the front surface being located forwardly of the lower portion thereof, said front edge and said upper portion being integrally formed so as to present a continuous swept forward lateral profile.

44. A skate support and bracket system as set forth in claim 39, wherein said lower end of the pedestal portion is connected to said upper track of the body so as to permit sliding of the pedestal portion longitudinally of the track.

45. A skate support and bracket system as set forth in claim 44, wherein said pedestal portion is continuously and infinitesimally slidable along said track.

46. A skate support and bracket system as set forth in claim 39, wherein said attachment track comprises a pair of laterally spaced, opposed, parallel, longitudinally extending grooves and said boot bracket includes a pair of laterally spaced, opposed, parallel, longitudinally extending ribs, said ribs being positioned in said grooves for sliding therealong.

47. A skate support and bracket system as set forth in claim 46, wherein said boot bracket includes a tightening mechanism for forcing the ribs laterally into tight frictional engagement with said grooves.

48. A skate support and bracket system as set forth in claim 39, wherein said support body is an extruded body.

49. A skate support and bracket system as set forth in claim 48, wherein said support body is tubular.

50. A skate support and bracket system as set forth in claim 39, wherein said pedestal portion has a central cavity extending therethrough longitudinally of said body presenting a pair of vertically extending laterally spaced leg segments.

51. A skate support and bracket system as set forth in claim 50, wherein said central cavity is substantially trapezoidal in shape.

52. A skate support and bracket system as set forth in claim 39, wherein said system includes two of said boot brackets, said brackets being spaced apart longitudinally of said track.

53. A skate support and bracket system as set forth in claim 52, wherein the platform of one of said brackets is closer to the body in a vertical direction than the platform of the other of said brackets.

54. A skate support and bracket system as set forth in claim 39, wherein a laterally extending boot stud receiving slot is provided in said shelf.

* * * * *